US012252767B2

(12) United States Patent
Robertson et al.

(10) Patent No.: US 12,252,767 B2
(45) Date of Patent: Mar. 18, 2025

(54) CEMENTED CARBIDE CONTAINING MULTI-COMPONENT HIGH ENTROPY CARBIDE AND/OR MULTI-COMPONENT HIGH ENTROPY ALLOY

(71) Applicant: Baker Hughes Oilfield Operations LLC, Houston, TX (US)

(72) Inventors: Andrew Robertson, The Woodlands, TX (US); Marc Bird, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 115 days.

(21) Appl. No.: 17/974,101

(22) Filed: Oct. 26, 2022

(65) Prior Publication Data

US 2024/0141461 A1 May 2, 2024

(51) Int. Cl.

| | |
|---|---|
| ***C22C 29/02*** | (2006.01) |
| ***B22F 5/00*** | (2006.01) |
| ***B22F 7/06*** | (2006.01) |
| ***B22F 7/08*** | (2006.01) |
| ***C22C 26/00*** | (2006.01) |
| ***C22C 29/00*** | (2006.01) |
| ***C22C 29/06*** | (2006.01) |
| ***C22C 29/08*** | (2006.01) |
| ***C22C 29/10*** | (2006.01) |

(52) U.S. Cl.

CPC ..... *C22C 29/02* (2013.01); *C22C 26/00* (2013.01); *C22C 29/005* (2013.01); *C22C 29/067* (2013.01); *B22F 2005/001* (2013.01); *B22F 7/06* (2013.01); *B22F 7/08* (2013.01); *C22C 2026/006* (2013.01); *C22C 29/06* (2013.01); *C22C 29/08* (2013.01); *C22C 29/10* (2013.01)

(58) Field of Classification Search

CPC ..... C22C 30/00; C22C 1/051; C22C 29/067; C22C 29/08; C22C 32/0052

See application file for complete search history.

(56) References Cited

U.S. PATENT DOCUMENTS

| | | | | |
|---|---|---|---|---|
| 2016/0016291 | A1* | 1/2016 | Westraadt | C04B 35/52 51/297 |
| 2019/0368278 | A1* | 12/2019 | Cao | C04B 35/528 |
| 2021/0197288 | A1* | 7/2021 | Norgren | B22F 3/16 |
| 2023/0052721 | A1 | 2/2023 | Pötschke et al. | |

FOREIGN PATENT DOCUMENTS

| | | | |
|---|---|---|---|
| CN | 1827817 A | * | 9/2006 |
| CN | 110104648 A | | 8/2019 |
| CN | 110484796 A | | 11/2019 |
| KR | 20220085121 A | | 6/2022 |

OTHER PUBLICATIONS

CN-1827817-A: Espacenet English machine translation (Year: 2006).*
Castle, et al., "Processing and Properties of High-Entropy Ultra-High Temperature Carbides", Scientific Reports 8.1, 2018: pp. 1-12.
Chicardi, et al., "Synthesis of all equiatomic five-transition metals High Entropy Carbides of the IVB (Ti, Zr, Hf) and VB (V, Nb, Ta) groups by a low temperature route", Ceramics International, 46, 2020: pp. 21421-21430.
Fan, et al., "Improved the microstructure and mechanical properties of AlFeCoNi high-entropy allow carbon addition", Materials Science and Engineering A 728, 2018: pp. 30-39.
Feng, et al., "Synthesis of single-phase high-entropy carbide powders", Scripta Materialia, 162, 2019: pp. 90-93.
International Search Report for International Application No. PCT/US2023/077125, International Filing Date Oct. 18, 2023, Date of Mailing Feb. 15, 2024: 4 pages.
Liang, et al., "High-content ductile coherent nanoprecipitates achieve ultrastrong high-entropy alloys", Nature Communications, 9.1, 2018: pp. 1-8.
Sarker, et al., "High-entropy high-hardness metal carbides discovered by entropy descriptors", Nature Communications, 9.1, 2018: pp. 1-10.
Wolf, et al., Influence of carbon on the formation of y/y' microstructure and y-phase in the WC/Co—Ni—Al-Wsystem: ab initio calculations and experimental studies, Journal of materials science, vol. 57, 2022: pp. 13779-13799.
Written Opinion for International Application No. PCT/US2023/077125, International Filing Date Oct. 18, 2023, Date of Mailing Feb. 15, 2024: 5 pages.
Yang, et al., "Multicomponent intermetallic nanoparticles and superb mechanical behaviors of complex alloys", Science, 2018: pp. 933-937.

* cited by examiner

*Primary Examiner* — Adil A. Siddiqui
(74) *Attorney, Agent, or Firm* — CANTOR COLBURN LLP

(57) ABSTRACT

A sintered cemented carbide includes a high entropy carbide or a spinodal decomposed product thereof; and a metallic binder containing at least one of Co, Co—Ru, Ni, Co—Ni, Co—Cr, Co—Ni—Cr, Co—Re, Co—Ni—Re, Co—Ni—Ru, or a high entropy alloy, wherein the high entropy carbide is a single-phase solid solution carbide comprising four to ten metallic elements, and the spinodal decomposed product thereof includes two chemically distinct phases having a same crystal structure. A sintered cemented carbide also includes a carbide including at least one of WC, TiC, ZrC, HfC, NbC, TaC, or $Cr_3C_2$; and a metallic binder including a high entropy alloy. The high entropy alloy is an alloy of four to ten alloy elements selected from Al, Be, Fe, Co, Cr, Ni, Cu, W, V, Zr, Ti, Mn, Hf, Nb, Mo, Ru, Re, Ge, Sn, C, B, or Si.

14 Claims, No Drawings

CEMENTED CARBIDE CONTAINING MULTI-COMPONENT HIGH ENTROPY CARBIDE AND/OR MULTI-COMPONENT HIGH ENTROPY ALLOY

BACKGROUND

Cemented carbide is a hard material that consists of fine particles of tungsten carbide, titanium carbide, or tantalum carbide cemented into a composite by a binder metal such as cobalt. While cemented carbide has been widely used in cutting tools, the material properties, such as fracture strength, fracture toughness, abrasion resistance, and corrosion resistance, can limit the use and performance of cemented carbide in various industrial applications. For example, cemented carbide fracture strength and abrasion resistance determine the durability of a roller-cone cutting structure and hence can limit bit design and performance. Accordingly, there is a continuing need for cemented carbides having improved material properties.

SUMMARY

In an aspect, a sintered cemented carbide includes a high entropy carbide or a spinodal decomposed product thereof; and a metallic binder comprising at least one of Co, Co—Ru, Ni, Co—Ni, Co—Cr, Co—Ni—Cr, Co—Re, Co—Ni—Re, Co—Ni—Ru, or a high entropy alloy, wherein the high entropy carbide is a single-phase solid solution carbide comprising four to ten metallic elements, and the spinodal decomposed product thereof comprises two chemically distinct phases having the same crystal structure; and the high entropy alloy is an alloy comprising four to ten alloy elements selected from Al, Be, Fe, Co, Cr, Ni, Cu, W, V, Zr, Ti, Mn, Hf, Nb, Mo, Ru, Re, Ge, Sn, C, B, or Si.

In another aspect, a sintered cemented carbide includes: a carbide comprising at least one of WC, TiC, ZrC, HfC, NbC, TaC, or $Cr_3C_2$; and a metallic binder comprising a high entropy alloy, wherein the high entropy alloy is an alloy comprising four to ten alloy elements selected from Al, Be, Fe, Co, Cr, Ni, Cu, W, V, Zr, Ti, Mn, Zr, Hf, Nb, Mo, Ru, Re, Ge, Sn, C, B, or Si.

An earth-boring tool has a body and at least a cutting element secured to the body, wherein the cutting element contains the above-described sintered cemented carbide.

A tool has a substrate and a polycrystalline diamond cutting element secured to the substrate, wherein the substrate contains the above-described sintered cemented carbide.

DETAILED DESCRIPTION

The inventors have discovered novel sintered cemented carbides that have improved material properties such as increased fracture strength and/or increased abrasion strength as compared to cemented carbides based on tungsten carbide cemented by cobalt metal. The discovery allows for the manufacture of high performing tools with increased service life. Due to the improved material properties, the high performing tools can also have more flexible tool design.

In an aspect, the sintered cemented carbide comprises a high entropy carbide, and a metallic binder comprising at least one of Co, Co—Ru, Ni, Co—Ni, Co—Cr, Co—Ni—Cr, Co—Re, Co—Ni—Re, Co—Ni—Ru or a high entropy alloy. The high entropy carbide can be present in an amount of about 60 to about 98 volume percent, about 70 to about 95 volume percent, or about 75 to about 95 volume percent, each based a total volume of the sintered cemented carbide. The metallic binder can be present in an amount of about 40 to about 2 volume percent, about 30 to about 5 volume percent, or about 25 to about 5 volume percent, each based on a total volume of the sintered cemented carbide. Preferably, the sintered cemented carbide does not contain any components other than the high entropy carbide or the metallic binder. In other words, the sintered cemented carbide consists of the high entropy carbide and the metallic binder.

As used herein, a high entropy carbide can refer to a single-phase solid solution carbide comprising at least four metallic elements, for example four to ten metallic elements, four to eight metallic elements, or four to six metallic elements. In the high entropy carbide, each metallic elements is present in an amount of about 5 to about 30 mole percent, preferably about 10 to about 30 mole percent or about 15 to about 30 mole percent, each based on a sum of the moles of the metallic elements. As used herein, a high entropy carbide also includes a carbide that is a high entropy carbide at high temperature, but undergoes a spinodal decomposition at a lower temperature whereby two chemically distinct phases of the same crystal structure form. Both phases of the decomposition would not typically be considered high entropy. Spinodal decomposition is a mechanism by which a single phase spontaneously separates into two phases. The decomposition could occur during the synthesis of the carbide powder, synthesis of the cemented carbide, or during a subsequent heat treatment.

In an embodiment, the high entropy carbide comprises carbon and at least four or at least five metallic elements, for example four to eight metallic elements, four to six metallic elements, four to five metallic elements, or five to six metallic elements selected from W, Zr, V, Ti, Ta, Nb, Mo, or Hf A molar content of the carbon in the high entropy carbide can be stoichiometric or sub-stoichiometric than a total molar content of the metallic elements in the high entropy carbide. For example, a ratio of a molar content of the carbon relative to a total molar content of the metallic elements in the high entropy carbide can be 0.9:1 to 1:1 or 0.95:1 to 1:1.

The high entropy carbide can have a formula of $XC_y$, wherein X comprises at least four or at least five metallic elements selected from W, Zr, V, Ti, Ta, Nb, Mo, or Hf, C is element carbon, and y is 0.9 to 1. For example, the high entropy carbide can have a formula of $(Hf_{0.2}Nb_{0.2}Ta_{0.2}Ti_{0.2}Zr_{0.2})C$, $(Hf_{0.2}Nb_{0.2}Ta_{0.2}Ti_{0.2}V_{0.2})C$, $(Hf_{0.2}Mo_{0.2}V_{0.2}W_{0.2}Zr_{0.2})C$, $(Hf_{0.2}Mo_{0.2}Ti_{0.2}W_{0.2}Zr_{0.2})C$, $(Nb_{0.2}Ta_{0.2}Ti_{0.2}V_{0.2}W_{0.2})C$, $(Hf_{0.2}Ta_{0.2}Ti_{0.2}Zr_{0.2}V_{0.2})C$, $(Hf_{0.2}Mo_{0.2}Ti_{0.2}V_{0.2}Zr_{0.2})C$, or $(Hf_{0.2}Ti_{0.2}V_{0.2}W_{0.2}Zr_{0.2})C$. The high entropy carbide can have a crystal structure such as a BCC (body centered cubic), FCC (face centered cubic), or HCP (hexagonal close packed) crystal structure.

The high entropy carbide can be prepared by powder metallurgy processes, using each binary carbides as raw materials. For example, at least four or at least five binary carbides can be mixed by mechanical mixing such as planetary ball milling and high-energy ball milling, and then the mixture is sintered via spark plasma sintering or discharge plasma sintering to form the high entropy carbide.

The high entropy alloy can also be produced by a two-step synthesis process consisting of carbothermal reduction of metal oxides by carbon such as carbon black followed by solid solution formation. Such a process is described by Feng, Lun, et al. in *Scripta Materialia* 162 (2019): 90-93.

Methods for preparing high entropy carbide are also described by Castle, Elinor, et al. in *Scientific reports* 8.1 (2018): 1-12; and by Sarker, Pranab, et al. in *Nature communications* 9.1 (2018): 1-10.

The high entropy carbide can also be prepared by dissolving five or more metallic salts such as a chloride or oxychloride salts in a solvent such as methanol, ethanol, and/or water to form a solution, the solution is mixed with a carbon source such as sucrose, fructose, glucose, decyl alcohol resin, and phenol resin to allow a sol-gel reaction to occur, and then reaction mixture is dried and heat treated at about 1500 to about 2500° C. as described in for example CN110104648 to form the high entropy carbide.

The metallic binder can comprise at least one of Co, Co—Ru, Ni, Co—Ni, Co—Cr, Co—Ni—Cr, Co—Re, Co—Ni—Re, Co—Ni—Ru or a high entropy alloy. As used herein, metal 1-metal 2 refers to an alloy of metal 1 and metal 2. For example, Co—Ru means an alloy of Co and Ru, and Co—Ni—Cr means an alloy of Co, Ni, and Cr.

As used herein, a high entropy alloy refers to an alloy that comprising four to ten, four to eight, or four to six alloy elements selected from Al, Be, Fe, Co, Cr, Ni, Cu, W, V, Zr, Ti, Mn, Zr, Hf, Nb, Mo, Ru, Re, Ge, Sn, C, B, or Si, preferably selected from Co, Cr, Cu, W, Fe, Ni, Mo, Ru, Re, or Mn. Each of the alloy elements can be present independently in about 1 to about 55 atomic percent (at. %), preferably 10 to about 30 atomic percent. The amount of each element may be the same or may be different. If present, the amount of C is less than 20 atomic percent. Specific examples of the high entropy alloy having six alloy elements includes $Cu_xFe_yNi_zTi_aV_bZr_c$, $Co_xCr_yFe_zMn_aNi_bV_c$, $Cu_xCo_yHf_zNi_aTi_bZr_c$, $Cu_xHf_yNb_zNi_aTi_bZr_c$, or $Co_xNi_yFe_zMn_aAl_bC_c$, wherein x+y+z+a+b+c=1, and each of x, y, z, a, b, and c is between about 0.05 to about 0.25, preferably about 0.1 to about 0.2, or about 0.14 to about 0.18. Examples of the high entropy alloy having five alloying elements include $Co_xCr_yFe_zMn_aNi_b$, $Co_xNi_yFe_zMn_aCu_b$, $Co_xNi_yFe_zMn_aRu_b$, $Co_xNi_yFe_zMn_aRe_b$, wherein x+y+z+a+b=1, and each of x, y, z, a, and b is between about 0.1 to about 0.3, preferably about 0.15 to about 0.25, or about 0.18 to about 0.22.

The alloy elements can form a primary FCC or BCC solid solution phase. The high entropy alloy can further include a secondary strengthening phase. A volume fraction of the secondary strengthening phase can be about 5 to about 50 percent, about 5 to about 40 percent, or about 5 to about 30 percent based on a sum of the volumes of the primary solid solution phase and the secondary strengthening phase.

Examples of the secondary strengthening phase includes at least one of an ordered $L1_2$ structured phase, or an $E2_1$ structured phase. The secondary strengthening phase can be an intermetallic phase, present as precipitates dispersed in a solid solution matrix or as one constituent phase in coupled eutectics.

The $L1_2$ phase can be of the form $A_3B$ where A is one or more of Ni, Co, Fe, Mn and B is one or more of Al, Ti, Sn, Si, Ge, Ru, Re, or W. Examples of a high entropy alloy with $L1_2$ phase is described by Yang, T., et al. in *Science* 362.6417 (2018): 933-937 and by Liang, Yao-Jian, et al. in *Nature communications* 9.1 (2018): 1-8.

The $E2_1$ phase can take the form of $A_3BC_x$, wherein C is the element carbon and x can vary between 0.25 and 1, A is one or more of Co, Ni, Fe, Mn, Ti, Zr, Hf and B is one or more of Al, Ti, Sn, Si, Ge, Ru, Re, or W. An example of a high entropy alloy with $E2_1$ phase is described by Fan, J. T., et al. in *Materials Science and Engineering: A* 728 (2018): 30-39.

The high entropy alloy can be prepared by several methods. One method involves mechanical mixing of elemental powders during powder processing of the cemented carbide, and sintering of the cemented carbide thereby producing the high entropy alloy. Another method includes mechanical high energy ball milling of elemental powders, and adding the milled powder to a milling process of the cemented carbide. The high entropy alloy can also be prepared through gas atomization of an alloy into a powder form. The atomized powder can then be added to a milling process of the cemented carbide.

In another aspect, the sintered cemented carbide comprises a carbide comprising at least one of WC, TiC, ZrC, HfC, NbC, TaC, or $Cr_3C_2$; and a metallic binder comprising a high entropy alloy as described herein. The carbide can be present in an amount of about 60 to about 98 volume percent, about 70 to about 95 volume percent, or about 75 to about 95 volume percent, each based a total volume of the sintered cemented carbide. The metallic binder can be present in an amount of about 40 to about 2 volume percent, about 30 to about 5 volume percent, or about 25 to about 5 volume percent, each based on a total volume of the sintered cemented carbide. Preferably, the sintered cemented carbide does not contain any components other than the carbide or the metallic binder. In other words, the sintered cemented carbide consists of the carbide and the metallic binder.

The sintered cemented carbides as described herein can be prepared by mixing the carbide such as a high entropy carbide or a carbide comprising at least one of WC, TiC, ZrC, HfC, NbC, TaC, or $Cr_3C_2$, with the metallic binder to form a mixture, then milling and sintering the mixture to form the sintered cemented carbides.

The method of milling is not particularly limited. Wet milling may be carried out by mixing a carbide powder, a metallic binder powder, and optionally an organic wax binder, such as paraffin wax or polyethylene glycol, for green strength, with a solvent such as an alcohol, acetone, hexane, heptane, water, or a combination thereof and milling the mixture using, for example, a ball mill, a rod mill, or an attritor mill for up to about 72 hours, typically about 12 to about 48 hours for ball mills. Dry milling may be performed using, for example, a ball mill without any solvent.

After milling, a slurry may be removed from a milling container, solid particles in the slurry then may be separated from the liquid solvent. For example, the liquid solvent of the slurry may be evaporated, or the solid particles may be filtered from the slurry to form a powder mixture. A powder mixture may also be produced from the slurry using, for example, a spray drying process as described in U.S. Pat. No. 7,528,086. The dried powder can be pressed into a green state prior to sintering.

Sintering methods can include vacuum sintering, hot isostatic pressing (HIP), spark plasma sintering, gas pressure sintering (GPS) etc. The sintering temperature is a temperature that is above the melting point of the metallic binder, for example about 10 to about 1000° C., or about 10 to about 50° C. above the melting point of the metallic binder.

The sintered cemented carbide can be used in various tools. In an aspect, The sintered cemented carbide can also be used as a substrate in in synthesis of polycrystalline diamond (PDC) cutting element. Synthesis of PDC involves using a high pressure high temperature (HPHT) apparatus, such as a cubic press or belt press, whereby the substrate and diamond powder are encapsulated in a refractory metal canister and subjected to a synthesis cycle with a pressure of greater than 5 GPa and a temperature of greater than 1300° C. The conditions can cause the carbide binder phase to melt, flow into the diamond powder bed, and catalytically sinter the diamond powder particles together. Accordingly, the disclosure also provides a tool such as a cutting element comprising a polycrystalline diamond composite, wherein the polycrystalline diamond composite includes a polycrystalline diamond and a substrate comprising a sintered cemented carbide as described herein.

In an aspect, a cutting element comprises the sintered cemented carbide, with or without the polycrystalline diamond. As used herein, the term "cutting element" means and includes any element of an earth-boring tool that is used to shear, crush, grind or otherwise remove formation materials when the earth-boring tool is used to form or enlarge a bore in the formation. The cutting element can have a generally cylindrical or disc shape.

An earth-boring tool can comprise a body; and at least one cutting element secured to the body, wherein the cutting element comprises the sintered cemented carbide as described herein. Cutting element can be made first, then secured to a bit body. Preparation of the cutting element is performed via sintering by methods as described hereinabove. Attachment of the cutting element to a bit body can involve either mechanical attachment such as pressing a cutter/compact into a properly sized hole of a roller cone or thermal assisted attachment such as brazing a cutter/compact into a pocket on the bit body.

As used herein, the term "earth-boring tool" means and includes any tool used to remove subterranean formation material and form a bore (e.g., a wellbore) through the formation by way of the removal of a portion of the formation material. Cutting elements may be secured to and used on earth-boring tools, including, for example, roller cone drill bits, percussion bits, core bits, eccentric bits, bi-center bits, reamers, expandable reamers, mills, hybrid bits, and other drilling bits and tools known in the art. As an example, a rotary drill bit can include a bit body, and the cutting elements secured to the bit body.

Set forth below are some embodiments of the foregoing disclosure.

Aspect 1. A sintered cemented carbide comprising: a high entropy carbide or a spinodal decomposed product thereof; and a metallic binder comprising at least one of Co, Co—Ru, Ni, Co—Ni, Co—Cr, Co—Ni—Cr, Co—Re, Co—Ni—Re, Co—Ni—Ru, or a high entropy alloy, wherein the high entropy carbide is a single-phase solid solution carbide comprising four to ten metallic elements, and the spinodal decomposed product thereof comprises two chemically distinct phases having a same crystal structure; and the high entropy alloy is an alloy comprising four to ten alloy elements selected from Al, Be, Fe, Co, Cr, Ni, Cu, W, V, Zr, Ti, Mn, Hf, Nb, Mo, Ru, Re, Ge, Sn, C, B, or Si.

Aspect 2. The sintered cemented carbide as in any prior aspect, wherein in the high entropy carbide or the spinodal decomposed product thereof, each metallic element is present in an amount of between about 5 to about 30 mole percent based on a sum of the moles of the metallic elements.

Aspect 3. The sintered cemented carbide as in any prior aspect, wherein the high entropy carbide or the spinodal decomposed product thereof comprises carbon and at least four metallic elements selected from W, Zr, V, Ti, Ta, Nb, Mo, or Hf.

Aspect 4. The sintered cemented carbide as in any prior aspect, wherein a molar content of the carbon in the high entropy carbide or the spinodal decomposed product thereof is stoichiometric to a total molar content of the metallic elements in the high entropy carbide or the spinodal decomposed product thereof.

Aspect 5. The sintered cemented carbide as in any prior aspect, wherein a molar content of the carbon in the high entropy carbide is sub-stoichiometric to a total molar content of the metallic elements in the high entropy carbide or the spinodal decomposed product thereof.

Aspect 6. The sintered cemented carbide as in any prior aspect, wherein in the high entropy alloy, the alloy elements form a primary face centered cubic or body centered cubic solid solution phase.

Aspect 7. The sintered cemented carbide as in any prior aspect, wherein the high entropy alloy further comprises a secondary strengthening phase.

Aspect 8. The sintered cemented carbide as in any prior aspect, wherein the secondary strengthening phase comprises at least one of an ordered $L1_2$ structured phase, or an $E2_1$ structured phase.

Aspect 9. The sintered cemented carbide as in any prior aspect, wherein the cemented carbide comprises about 60 to about 98 volume percent of the high entropy carbide and about 40 to 2 volume percent of the metallic binder, each based on a total volume of the sintered cemented carbide.

Aspect 10. The sintered cemented carbide as in any prior aspect consisting of the high entropy carbide and the metallic binder.

Aspect 11. A sintered cemented carbide comprising: a carbide comprising at least one of WC, TiC, ZrC, HfC, NbC, TaC, or $Cr_3C_2$; and a metallic binder comprising a high entropy alloy, wherein the high entropy alloy is an alloy comprising four to ten alloy elements selected from Al, Be, Fe, Co, Cr, Ni, Cu, W, V, Zr, Ti, Mn, Hf, Nb, Mo, Ru, Re, Ge, Sn, C, B, or Si.

Aspect 12. The sintered cemented carbide as in any prior aspect, wherein the cemented carbide comprises about 60 to about 98 volume percent of the carbide, and about 40 to about 2 volume percent of the metallic binder, each based on a total volume of the sintered cemented carbide.

Aspect 13. The sintered cemented carbide as in any prior aspect consisting of the carbide and the metallic binder.

Aspect 14. The sintered cemented carbide as in any prior aspect, wherein in the high entropy alloy, the alloy elements form a primary face centered cubic or body centered cubic solid solution phase.

Aspect 15. The sintered cemented carbide as in any prior aspect, wherein the high entropy alloy further comprises a secondary strengthening phase.

Aspect 16. The sintered cemented carbide as in any prior aspect, wherein the secondary strengthening phase comprises at least one of an ordered $L1_2$ structured phase, or an $E2_1$ structured phase.

Aspect 17. The sintered cemented carbide as in any prior aspect, wherein the secondary strengthening phase comprises the $L1_2$ phase, and the $L1_2$ phase is of a form $A_3B$ where A is one or more of Ni, Co, Fe, or Mn, B is one or more of Al, Ti, Sn, Si, Ge, Ru, Re, or W.

Aspect 18. The sintered cemented carbide as in any prior aspect, wherein the secondary strengthening phase comprises the $E2_1$ phase, and the $E2_1$ phase is of a form of $A_3BC_x$, C is the element carbon, and x varies between 0.25 and 1; A is one or more of Co, Ni, Fe, Mn, Ti, Zr, or Hf; and B is one or more of Al, Ti, Sn, Si, Ge, Ru, Re, or W.

Aspect 19. An earth-boring tool comprising a body and at least a cutting element secured to the body, wherein the cutting element comprises the sintered cemented carbide as in any prior aspect.

Aspect 20. A tool comprising a polycrystalline diamond composite, wherein the polycrystalline diamond composite comprises a polycrystalline diamond and a substrate comprising the sintered cemented carbide as in any prior aspect.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

What is claimed is:

1. A sintered cemented carbide comprising:

a high entropy carbide or a spinodal decomposed product thereof; and a metallic binder comprising at least one of Co, Co—Ru, Ni, Co—Ni, Co—Cr, Co—Ni—Cr, Co—Re, Co—Ni—Re, Co—Ni—Ru, or a high entropy alloy, wherein the high entropy carbide is a single-phase solid solution carbide comprising four to ten metallic elements, and the spinodal decomposed product thereof comprises two chemically distinct phases having a same crystal structure; and the high entropy alloy is an alloy comprising four to ten alloy elements selected from the group consisting of Al, Be, Fe, Co, Cr, Ni, Cu, W, V, Zr, Ti, Mn, Hf, Nb, Mo, Ru, Re, Ge, Sn, C, B, and or Si.

2. The sintered cemented carbide of claim 1, wherein in the high entropy carbide or the spinodal decomposed product thereof, each metallic element is present in an amount of between about 5 to about 30 mole percent based on a sum of the moles of the metallic elements.

3. The sintered cemented carbide of claim 1, wherein the high entropy carbide or the spinodal decomposed product thereof comprises carbon and at least four metallic elements selected from the group consisting of W, Zr, V, Ti, Ta, Nb, Mo, and Hf.

4. The sintered cemented carbide of claim 3, wherein a molar content of the carbon in the high entropy carbide or the spinodal decomposed product thereof is stoichiometric to a total molar content of the metallic elements in the high entropy carbide or the spinodal decomposed product thereof.

5. The sintered cemented carbide of claim 3, wherein a molar content of the carbon in the high entropy carbide or the spinodal decomposed product thereof is sub-stoichiometric to a total molar content of the metallic elements in the high entropy carbide or the spinodal decomposed product thereof.

6. The sintered cemented carbide of claim 1, wherein in the high entropy alloy, the alloy elements form a primary face centered cubic or body centered cubic solid solution phase.

7. The sintered cemented carbide of claim 6, wherein the high entropy alloy further comprises a secondary strengthening phase.

8. The sintered cemented carbide of claim 7, wherein the secondary strengthening phase comprises at least one of an ordered $L1_2$ structured phase, or an $E2_1$ structured phase.

9. The sintered cemented carbide of claim 1, wherein the cemented carbide comprises about 60 to about 98 volume percent of the high entropy carbide and about 40 to 2 volume percent of the metallic binder, each based on a total volume of the sintered cemented carbide.

10. The sintered cemented carbide of claim 9, consisting of the high entropy carbide and the metallic binder.

11. The sintered cemented carbide of claim 1, comprising the spinodal decomposed product of the high entropy carbide.

12. The sintered cemented carbide of claim 1, wherein the high entropy alloy is an alloy comprising five to ten alloy elements selected from the group consisting of Al, Be, Fe, Co, Cr, Ni, Cu, W, V, Zr, Ti, Mn, Hf, Nb, Mo, Ru, Re, Ge, Sn, C, B, and Si.

13. An earth-boring tool comprising a body and at least a cutting element secured to the body, wherein the cutting element comprises the sintered cemented carbide of claim 1.

14. A tool comprising a polycrystalline diamond composite, wherein the polycrystalline diamond composite comprises a polycrystalline diamond and a substrate comprising the sintered cemented carbide of claim 1.

* * * * *